US006616993B2

(12) United States Patent
Usuki et al.

(10) Patent No.: US 6,616,993 B2
(45) Date of Patent: Sep. 9, 2003

(54) PROTECTIVE LAYER TRANSFER SHEET

(75) Inventors: Hideki Usuki, Tokyo-To (JP); Satoshi Moriguchi, Tokyo-To (JP); Naohiro Obonai, Tokyo-To (JP); Hitoshi Saito, Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/794,235

(22) Filed: Feb. 28, 2001

(65) Prior Publication Data

US 2002/0197453 A1 Dec. 26, 2002

(30) Foreign Application Priority Data

Mar. 3, 2000 (JP) ..... 2000-058280

(51) Int. Cl.[7] ..... B41M 5/40
(52) U.S. Cl. ..... 428/32.79; 428/32.81
(58) Field of Search ..... 8/471; 428/195, 428/913, 914, 32.79, 32.81; 503/227

(56) References Cited

U.S. PATENT DOCUMENTS 5,427,997 A * 6/1995 Oshima et al. ..... 503/227

* cited by examiner

*Primary Examiner*—B. Hamilton Hess
(74) *Attorney, Agent, or Firm*—Parkhurst & Wendel, L.L.P.

(57) ABSTRACT

The present invention provides a protective layer transfer sheet which, when used to thermally transfer a protective layer onto an image-receiving sheet with an image formed thereon, provides a print that does not cause cracking of the protective layer and, even when housed and stored in a vinyl chloride case containing a plasticizer or the like, does not cause the migration of a dye constituting the image to the case, that is, has excellent fastness properties. In a protective layer transfer sheet 7 comprising a substrate sheet 1, a heat-resistant slip layer 3 provided on one side of the substrate sheet 1, and a thermally transferable protective layer 2 releasably provided on at least a part of the surface of the substrate sheet 1 remote from the heat-resistant slip layer 3, the thermally transferable protective layer 2 contains an epoxy resin and, in addition, contains at least one member selected from the group consisting of a butyral resin, an acrylic resin, and an ultraviolet absorber. By virtue of this construction, a protective layer 2 is strongly adhered onto an image-receiving sheet with an image formed thereon. Further, the protective layer 2 is strong and homogeneous, and, thus, even when the print is housed in a vinyl chloride case, the print does not cause the dye to migrate to the case, that is, has excellent plasticizer resistance.

8 Claims, 1 Drawing Sheet

PROTECTIVE LAYER TRANSFER SHEET

TECHNICAL FIELD

The present invention relates to a protective layer transfer sheet which can form a protective layer by thermal transfer on an object, such as an image-receiving sheet with an image formed thereon. More particularly, the present invention relates to a protective layer transfer sheet which, when used to transfer a protective layer onto a print, can impart excellent fastness properties to the print.

BACKGROUND OF THE INVENTION

At the present time, thermal transfer recording is widely used as a simple printing method. The thermal transfer recording can simply form various images, and thus is utilized in printing wherein the number of prints may be relatively small, for example, the preparation of ID cards, such as identification cards, photographs for business, or printers of personal computers or video printers. When a full-color halftone image, such as a photograph-like image of a face, is preferred, the thermal transfer sheet used is such that, for example, various colorant layers of yellow, magenta, and cyan (and, in addition, optionally black) are provided as ink layers in a large number in a face serial manner on a continuous substrate film. Such thermal transfer sheets are classified roughly into thermal transfer sheets of the so-called "melt transfer (ink transfer)" type wherein the colorant layer is melted and softened upon heating and as such is transferred onto an object, that is, an image-receiving sheet, and thermal transfer sheets of the so-called "sublimation (dye transfer)" type wherein, upon heating, a dye contained in the colorant layer is sublimated to permit the dye to migrate onto the image-receiving sheet.

When the above thermal transfer sheet is used, for example, to prepare ID cards, such as identification cards, the melt transfer type is advantageous in that line images, such as letters or numeric characters, can be easily formed, but on the other hand, the fastness properties, particularly abrasion resistance, of the formed images are disadvantageously poor. On the other hand, the sublimation type is suitable for the formation of halftone images, such as photograph-like images of a face. Unlike conventional printing inks, however, no vehicle is used. Therefore, the formed images are poor in fastness properties such as abrasion resistance, and, in addition, when brought into contact, for example, with plasticizer-containing card cases, file sheets, erasers made of plastics or the like, disadvantageously cause migration of dyes onto them. Further, the formed images have poor chemical resistance, solvent resistance and other properties and hence cause blurring or other unfavorable phenomena. For this reason, an attempt to further transfer a protective layer on the formed image from a protective layer transfer sheet has been made to further impart improved fastness properties, such as abrasion resistance, chemical resistance, and solvent resistance, to the formed images. For example, a protective layer transfer sheet comprising a substrate film, a transparent resin layer releasably provided on the substrate film, and a heat-sensitive adhesive layer provided on the transparent resin layer is used to transfer and stack a transparent resin layer on an object with an image formed thereon through the heat-sensitive adhesive layer.

The image-receiving face with an image being transferred by sublimation dye transfer is highly releasable from the viewpoint of preventing heat fusing between the image-receiving face and the dye in the thermal transfer sheet, but on the other hand, the adhesion is low. Therefore, in the conventional protective layer transfer sheet, the adhesion of the protective layer to the image-receiving sheet is unsatisfactory, and, thus, when the print is stored under some conditions, the transferred protective layer is disadvantageously cracked.

Further, when a print comprising a protective layer thermally transferred onto an image-receiving sheet with an image formed thereon is housed and stored in a vinyl chloride case, a dye constituting the image in the print migrates to the case and this disadvantageously poses problems such as lowered image density of the print.

Accordingly, it is an object of the present invention to provide a protective layer transfer sheet, comprising a substrate sheet and a thermally transferable protective layer releasably provided on the substrate sheet, which, when used to thermally transfer a protective layer onto an image-receiving sheet with an image formed thereon, can provide a print that does not cause cracking of the protective layer and, even when housed and stored in a vinyl chloride case containing a plasticizer or the like, does not cause the migration of a dye constituting the image to the case, that is, has excellent fastness properties.

DISCLOSURE OF THE INVENTION

According to the present invention, there is provided a protective layer transfer sheet comprising: a substrate sheet; and a thermally transferable protective layer releasably provided on the substrate sheet, said thermally transferable protective layer containing an epoxy rein and, in addition, containing at least one member selected from the group consisting of a butyral resin, an acrylic resin, an ultraviolet absorber, and a mixture thereof.

Thus, in this protective layer transfer sheet according to the present invention, since the thermally transferable protective layer contains, in addition to an epoxy resin, at least one member selected from the group consisting of a butyral resin, an acrylic resin, an ultraviolet absorber, and a mixture thereof, the protective layer is strongly adhered onto an image-receiving sheet with an image formed thereon. Further, the protective layer is strong and homogeneous, and, thus, even when the print is housed in a vinyl chloride case, the print does not cause the dye to migrate to the case, that is, has excellent plasticizer resistance.

According to a preferred embodiment of the present invention, the thermally transferable protective layer comprises a combination of a release layer, a main protective layer, and an adhesive layer provided in that order from the substrate sheet side, and the adhesive layer contains an epoxy resin and, in addition, contains at least one member selected from the group consisting of a butyral resin, an acrylic resin, and an ultraviolet absorber. Also in this embodiment, since the adhesive layer, which comes into contact with the image-receiving sheet upon the transfer of a protective layer onto the image-receiving sheet, contains an epoxy resin and, in addition, contains at least one member selected from the group consisting of a butyral resin, an acrylic resin, and an ultraviolet absorber, the adhesive layer is strongly adhered onto the image-receiving sheet with an image formed thereon. Further, in particular, the adhesive layer is strong and homogeneous, and, thus, even when the print is housed in a vinyl chloride case, the print does not cause the dye to migrate to the case, that is, has excellent plasticizer resistance.

According to a preferred embodiment of the present invention, the release layer contains at least an acrylic resin.

Further, in the present invention, preferably, the release layer is non-transferable, and, upon thermal transfer, the release layer stays on the substrate sheet while the protective layer is separable from the substrate sheet.

According to another embodiment of the present invention, upon thermal transfer, the thermally transferable protective layer may be separable directly from the substrate sheet.

Further, preferably, the epoxy resin has a molecular weight in the range of 800 to 6000 and a glass transition temperature of 60 to 150° C.

BEST MODE FOR CARRYING OUT THE INVENTION

Next, the present invention will be described in more detail with reference to the following embodiments.

Figure 1:
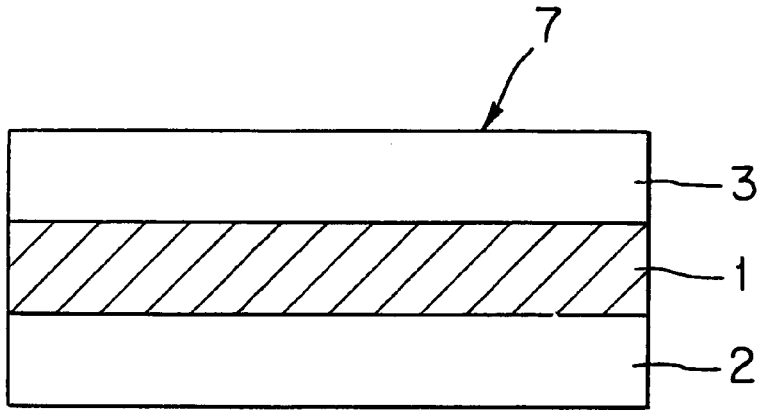
FIG. 1 is a cross-sectional view showing an embodiment of the protective layer transfer sheet according to the present invention.

FIG. 1 is a cross-sectional view showing an embodiment of a protective layer transfer sheet 7 according to the present invention. In the protective layer transfer sheet 7, a heat-resistant slip layer 3 is provided on one side of a substrate sheet 1, and a thermally transferable protective layer 2 is provided on the other side of the substrate sheet 1. The thermally transferable protective layer 2 can be thermally separated from the substrate sheet 1.

Figure 2:
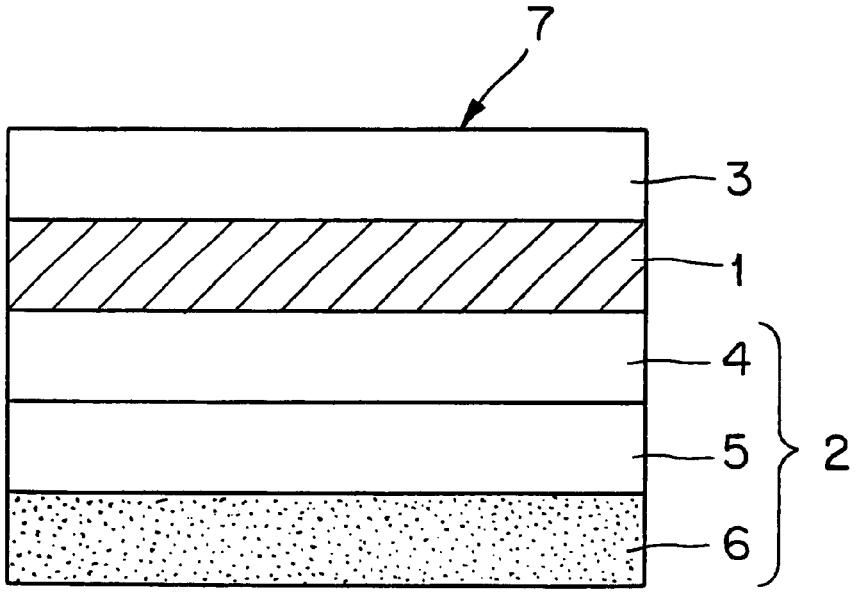
FIG. 2 is a cross-sectional view showing another embodiment of the protective layer transfer sheet according to the present invention.

FIG. 2 is a cross-sectional view showing another embodiment of the protective layer transfer sheet 7 according to the present invention. In the protective layer transfer sheet 7, a heat-resistant slip layer 3 is optionally provided on one side of the substrate sheet 1, and a release layer 4, a main protective layer 5, and an adhesive layer 6 are provided in that order on the other side of the substrate sheet 1. In this case, the thermally transferable protective layer 2 has a three-layer structure comprising a release layer 4, a main protective layer 5, and an adhesive layer 6. That is, the main protective layer 5 is provided on the substrate sheet 1 through the release layer 4 so that the main protective layer 5 can be easily separated from the substrate sheet 1 through the release layer 4. The release layer 4 is non-transferable, and, upon thermal transfer, the release layer 4 stays on the substrate sheet 1. On the other hand, the main protective layer 5 is transferred onto the image-receiving sheet through the adhesive layer 6 so that a protective layer derived from the thermally transferable protective layer 2 is strongly adhered onto the image-receiving sheet as an object.

Next, the layers constituting the protective layer transfer sheet according to the present invention will be described.

(Substrate Sheet)

In the protective layer transfer sheet of the present invention, any substrate sheet used in conventional thermal transfer sheets as such may be used as the substrate sheet 1. Other substrate sheets may also be used without particular limitation. Specific examples of preferred substrate sheets include tissue papers, such as glassine paper, capacitor paper, and paraffin paper; plastics, such as polyesters, polypropylene, cellophane, polycarbonate, cellulose acetate, polyethylene, polyvinyl chloride, polystyrene, nylon, polyimide, polyvinylidene chloride, and ionomers; and composite substrate sheets comprising combinations of the tissue papers and the plastics. The thickness of the substrate sheet may be properly varied depending upon materials for the substrate sheet so that the substrate sheet has proper strength, heat resistance and other properties. However, the thickness is preferably 2 to 100 $\mu$m.

(Thermally Transferable Protective Layer)

In the protective layer transfer sheet according to the present invention, the thermally transferable protective layer 2 releasably provided on the substrate sheet is mainly composed of a main protective layer 5 as one layer in the thermally transferable protective layer 2 having a multi-layer structure, or a thermally transferable protective layer 2 having a single-layer structure, and contains an epoxy resin and, in addition, contains at least one member selected from the group consisting of a butyral resin, an acrylic resin, and an ultraviolet absorber.

In the resin for the protective layer, in addition to the above resins, for example, polyester resin, polycarbonate resin, polystyrene resin, polyurethane resin, silicone-modified products of the above resins, and mixtures of the above resins may be optionally added.

The epoxy resin is produced by reacting an active hydrogen-containing compound with epichlorohydrin and then dechlorinating the reaction product. Epoxy resins usable herein include novolak epoxy resins, β-methylepichloro epoxy resins, alicyclic epoxy resins, acyclic aliphatic epoxy resins, and polycarboxylic ester epoxy resins. The epoxy resin preferably has a molecular weight of 800 to 6000 and a glass transition temperature of 60 to 150° C. from the viewpoint of improving fastness properties as the protective layer, suitability for mixing, for example, with other resins or ultraviolet absorbers, and adhesion to the substrate sheet and the like.

The thermally transferable protective layer comprises a combination of an epoxy resin as a first component and other resin as a second component. Preferred examples of the second component, that is, the resin component other than the epoxy resin, include butyral resins, acrylic resins, polyester resins, polycarbonate resins, polystyrene resins, polyurethane resins, and ultraviolet absorbers. In particular, the addition of the butyral resin, the acrylic resin, and/or the ultraviolet absorber as the second component is preferred from the viewpoints of improved strength of the protective layer, excellent homogeneity of the layer, and good fastness properties.

The ultraviolet absorber may be, for example, a resin produced by introducing a reactive group, such as an addition-polymerizable double bond (for example, a vinyl, acryloyl, or methacryloyl group) or an alcoholic hydroxyl, amino, carboxyl, epoxy, or isocyanate group into a conventional organic nonreactive ultraviolet absorber, for example, a salicylate, benzophenone, benzotriazole, substituted acrylonitrile, nickel chelate, or hindered amine nonreactive ultraviolet absorber.

The mixing ratio of the first component to the second component is preferably 40 to 95 parts by weight: 60 to 5 parts by weight.

The thermally transferable protective layer having a single-layer structure or the main protective layer provided in the thermally transferable protective layer having a multi-layer structure may be formed, for example, by coating a resin by gravure printing, screen printing, reverse coating using a gravure plate or other coating means, and drying the coating to form a layer generally having a thickness of about 0.5 to 10 $\mu$m on the dried state, although the method used varies depending upon the type of the resin for the protective layer.

(Heat-Resistant Slip Layer)

In the protective layer transfer sheet according to the present invention, a heat-resistant slip layer 3 is provided on the backside of the substrate sheet, that is, on the substrate in its side remote from the thermally transferable protective layer, from the viewpoint of avoiding adverse effects, such as sticking or cockling caused by heat from the thermal head.

Any conventional resin may be used as the resin for the formation of the heat-resistant slip layer, and examples thereof include polyvinylbutyral resins, polyvinylacetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, urethane or epoxy prepolymers, nitrocellulose resins, cellulose nitrate resins, cellulose acetopropionate resins, cellulose acetate butyrate resins, cellulose acetate hydrogenphthalate resins, cellulose acetate resins, aromatic polyamide resins, polyimide resins, polycarbonate resins, and chlorinated polyolefin resins.

Slip property-imparting agents added to or coated on the heat-resistant slip layer formed of the above resin include phosphoric esters, silicone oils, graphite powders, silicone graft polymers, fluoro graft polymers, acrylic silicone graft polymers, acrylsiloxanes, arylsiloxanes, and other silicone polymers. Preferably, the heat-resistant slip layer is formed of a polyol, for example, a polyalcohol polymer compound, a polyisocyanate compound, or a phosphoric ester compound. Further, the addition of a filler is more preferred.

The heat-resistant slip layer may be formed by dissolving or dispersing the above resin, slip property-imparting agent, and filler in a suitable solvent to prepare an ink for a heat-resistant slip layer, coating the ink on the backside of the substrate sheet, for example, by gravure printing, screen printing, reverse coating using a gravure plate or other coating means, and drying the coating.

(Release Layer)

When the protective layer is less likely to separate from the substrate sheet, a release layer 4 may be formed between the substrate sheet and the protective layer. The release layer may be formed of, for example, various waxes, such as silicone wax, or a resin, such as a silicone resin, a fluororesin, an acrylic resin, a polyurethane resin, a polyvinylpyrrolidone resin, a polyvinyl alcohol resin, or a polyvinyl acetal resin. Cured resin may also be used.

Among these resins, a resin produced by polymerization of a monomer, such as acrylic acid or methacrylic acid, or by copolymerization of a monomer, such as acrylic acid or methacrylic acid, with other monomer or the like is preferred as the acrylic resin which is excellent in adhesion to the substrate sheet, as well as in releasability from the protective layer.

The release layer may be properly selected from a type which is transferred onto an object upon thermal transfer, a type which is left on the substrate sheet side upon thermal transfer, a type which is subjected to cohesive failure and the like. From the viewpoints of excellent surface gloss, transfer stability of the protective layer and the like, the type is preferably such that the release layer is non-transferable and, upon thermal transfer, remains on the substrate sheet side so that the interface between the release layer and the protective layer serves as the surface of the protective layer after the thermal transfer.

The release layer may be formed in the same manner as described above in connection with the formation of the protective layer mentioned in the thermally transferable protective layer. A release layer thickness of about 0.5 to 5 $\mu$m on a dry basis suffices for the contemplated results. When a protective layer, which becomes matte upon transfer, is desired, the incorporation of various particles in the release layer or matting treatment of the surface of the release layer on the main protective layer side can provide a protective layer having a matte surface.

It should be noted that, when the releasability of the protective layer from the substrate sheet is good, there is no need to provide the release layer. In this case, upon thermal transfer, the protective layer can be released directly from the substrate sheet.

(Adhesive Layer)

According to the present invention, an adhesive layer 6 is preferably provided on the outermost surface of the transferable protective layer in the protective layer transfer sheet, that is, on the main protective layer, from the viewpoint of improving the adhesion of the protective layer to the image-receiving sheet. The adhesive layer may be formed of any conventional pressure-sensitive adhesive or heat-sensitive adhesive, more preferably a thermoplastic resin having a glass transition temperature of 50 to 80° C. For example, it is preferred to select a resin having a suitable glass transition temperature from resins having good adhesion in a hot state, for example, from polyester resins, polycarbonate resins, butyral resins, acrylic resins, ultraviolet absorbing resins, epoxy resins, vinyl chloride-vinyl acetate copolymer resins, polyamide resins, and vinyl chloride resins. In particular, the use of an epoxy resin and, in addition, at least one of butyral resin, acrylic resin, and ultraviolet absorbers in the adhesive layer is preferred because the adhesive layer is strong and has excellent homogeneity and good lightfastness.

The use of the epoxy resin and the addition of at least one of butyral resin, acrylic resin, and ultraviolet absorbers in the adhesive layer are common to the adhesive layer and the thermally transferable protective layer, and, thus, the explanation thereof will be omitted.

The adhesive layer may be formed by coating a coating liquid containing a resin for constituting the adhesive layer and optionally other additives and drying the coating to form an adhesive layer preferably having a thickness of about 0.5 to 10 $\mu$m on a dry basis.

For the protective layer transfer sheet, the transferable protective layer may be solely provided on the substrate sheet. Alternatively, the transferable protective layer, together with dye layers of Y (yellow), M (magenta), and C (cyan) colors or a hot-melt ink layer, may be provided in a face serial manner.

The image-receiving sheet as an object on which an image is formed and, in addition, a protective layer is transferred from the protective layer transfer sheet, is not particularly limited. For example, the substrate may be any sheet of plain papers, wood-free papers, tracing papers, plastic films and the like. The substrate may be in any form of cards, postcards, passports, letter papers, report pads, notes, catalogues and the like. The substrate may have on its surface a receptive layer receptive to a dye. It should be noted that, when the substrate per se is receptive to a dye, there is no need to provide any receptive layer.

The protective layer may be transferred by using any heating-pressing means, which can heat the protective layer or the release layer or the adhesive layer to a temperature at which this layer can be activated, for example, a conventional printer provided with a thermal head for thermal transfer, a hot stamper for foil transfer, or a hot roll. An image may be formed by any conventional means. For example, a contemplated purpose can be satisfactorily attained by applying a thermal energy of about 5 to 100 mJ/dot (in the case of 300 dpi) by means of a recording apparatus, such as a thermal printer (for example, a printer P-330, manufactured by Olympus Optical Co., Ltd.), through the control of the recording time.

Further, the protective layer transfer sheet according to the present invention may be used to prepare ID cards, identification cards, license cards and other cards. These cards contain information on letters in addition to information on images such as photographs. In this case, for example, a method may be used wherein information on letters is formed by a melt transfer method while a photograph-like image or other image may be formed by a sublimation transfer method (a dye transfer method). Embosses, signatures, IC memories, magnetic layers, holograms, and other prints may also be provided on the cards. In this case, these embosses, signatures, magnetic layers and the like may be provided after the transfer of the protective layer.

EXAMPLES

The present invention will be described in more detail with reference to the following examples and comparative example. In the following examples and comparative example, "parts" or "%" is by mass unless otherwise specified.

Example 1

The following coating liquid for a release layer was coated by gravure printing on the surface of a polyethylene terephthalate film (PET, thickness 6.0 $\mu$m, manufactured by Toray Industries, Inc.) having a heat-resistant slip layer on its backside at a coverage on a dry basis of 1.0 g/m$^2$. The coating was dried to form a release layer. The following coating liquid for a main protective layer was then coated by gravure printing on the surface of the release layer at a coverage on a dry basis of 3.0 g/m$^2$. The coating was then dried to form a main protective layer. Further, the following coating liquid for an adhesive layer was coated by gravure printing on the main protective layer at a coverage on a dry basis of 3.0 g/m$^2$, and the coating was dried in the same manner as described just above to form an adhesive layer. Thus, a protective layer transfer sheet of Example 1 according to the present invention was prepared.

| | |
|---|---|
| Coating liquid for release layer | |
| Silicone-modified acrylic resin (CELTOP 226, manufactured by Daicel Chemical Industries, Ltd.) | 16 parts |
| Aluminum catalyst (CELTOP CAT-A, manufactured by Daicel Chemical Industries, Ltd.) | 3 parts |
| Methyl ethyl ketone | 8 parts |
| Toluene | 8 parts |
| Coating liquid for main protective layer | |
| Acrylic resin (Dianal BR-83, manufactured by Mitsubishi Rayon Co., Ltd.) | 50 parts |
| Methyl ethyl ketone | 25 parts |
| Toluene | 25 parts |
| Coating liquid for adhesive layer | |
| Butyral resin (#2000L, manufactured by Denki Kagaku Kogyo K.K.) | 10 parts |
| Epoxy resin (Epikote 1007, manufactured by Yuka Shell Epoxy K.K.) | 20 parts |
| Benzotriazole ultraviolet absorber (TINUVIN 900, manufactured by CIBA-GEIGY Ltd.) | 6 parts |
| Benzotriazole ultraviolet absorber (TINUVIN 320, manufactured by CIBA-GEIGY Ltd.) | 3 parts |
| Methyl ethyl ketone | 10 parts |

Example 2

A release layer, a main protective layer, and an adhesive layer were coated in that order on a polyethylene terephthalate film with a heat-resistant slip layer coated thereon in the same manner as in Example 1, except that, in the formation of the adhesive layer, the following coating liquid was used. Thus, a protective layer transfer sheet of Example 2 was prepared.

| Coating liquid for adhesive layer | |
|---|---|
| Acrylic resin (Dianal BR-83, manufactured by Mitsubishi Rayon Co., Ltd.) | 10 parts |
| Epoxy resin (Epikote 1007, manufactured by Yuka Shell Epoxy K.K.) | 20 parts |
| Benzotriazole ultraviolet absorber (TINUVIN 900, manufactured by CIBA-GEIGY Ltd.) | 4 parts |
| Benzotriazole ultraviolet absorber (TINUVIN 320, manufactured by CIBA-GEIGY Ltd.) | 2 parts |
| Methyl ethyl ketone | 10 parts |

Example 3

A release layer, a main protective layer, and an adhesive layer were coated in that order on a polyethylene terephthalate film with a heat-resistant slip layer coated thereon in the same manner as in Example 1, except that, in the formation of the adhesive layer, the following coating liquid was used. Thus, a protective layer transfer sheet of Example 3 was prepared.

| Coating liquid for adhesive layer | |
|---|---|
| Epoxy resin (Epikote 1007, manufactured by Yuka Shell Epoxy K.K.) | 30 parts |
| Benzotriazole ultraviolet absorber (TINUVIN 900, manufactured by CIBA-GEIGY Ltd.) | 4 parts |
| Benzotriazole ultraviolet absorber (TINUVIN 320, manufactured by CIBA-GEIGY Ltd.) | 2 parts |
| Methyl ethyl ketone | 10 parts |

Comparative Example

A release layer, a main protective layer, and an adhesive layer were coated in that order on a polyethylene terephthalate film with a heat-resistant slip layer coated thereon in the same manner as in Example 1, except that, in the formation of the adhesive layer, the following coating liquid was used. Thus, a protective layer transfer sheet of Comparative Example was prepared.

| Coating liquid for adhesive layer | |
|---|---|
| Vinyl chloride-vinyl acetate copolymer resin (1000 ALK, manufactured by Mitsubishi Gas Chemical Co., Inc.) | 40 parts |
| Acrylic copolymer as ultraviolet absorber (UVA 635L, manufactured by BASF Japan) | 30 parts |
| Methyl ethyl ketone | 10 parts |
| Toluene | 10 parts |

1. Evaluation of Dye Migration

A printer P-330 manufactured by Olympus Optical Co., Ltd. was provided as a dye sublimation transfer printer. A full color test pattern was printed by means of this printer using a specialty image-receiving sheet and a specialty thermal transfer sheet for the printer. Further, a protective layer was transferred from each of the protective layer transfer sheets prepared above onto the surface of the print by means of the above printer.

Thereafter, a vinyl chloride sheet and the print were put on top of each other so that the sheet faced the print in its image face (provided with the protective layer) under the following conditions, and visual inspection was carried out for the migration of the dye constituting the image to the vinyl chloride sheet.

(1) A clear case (a vinyl chloride sheet) manufactured by LIHIT was provided. The print was housed in the case, and was allowed to stand for 350 hr at a load of 0.78 $N/cm^2$ in a storage environment of 40° C. and 90% RH.

(2) Arutoron (a vinyl chloride sheet, manufactured by Mitsubishi Chemical Corporation) was provided. This sheet and the print were put on top of each other so that the sheet faced the image face, and the assembly was allowed to stand for 200 hr at a load of 0.49 $N/cm^2$ in a storage environment of 50° C. and the dry.

Dye migration was evaluated according to the following criteria. ○: No dye migration Δ: Slight dye migration ×: Significant dye migration 2. Evaluation of Cracking In the same manner as used in the evaluation of the dye migration, printing was carried out on the image-receiving sheet, and a protective layer was transferred onto the surface of the print. Thereafter, under the above-described conditions (1) and (2), the vinyl chloride sheet and the print were put on top of each other so that the sheet faced the print in its image face (provided with the protective layer), followed by visual inspection of the protective layer for cracking. The results were evaluated according to the following criteria.

○: No cracking

Δ: Slight cracking

×: Significant cracking

The results were as shown in Table 1 below. The results shown in Table 1 are collective evaluation results obtained under the conditions (1) and (2).

TABLE 1

| | Dye migration | Cracking |
|---|---|---|
| Ex. 1 | ○ | ○ |
| Ex. 2 | ○ | ○ |
| Ex. 3 | ○ | ○ |
| Comp. Ex. | x | x |

For Examples 1 to 3, there was no migration of the dye in the image portion of the print to the vinyl chloride sheet, and, in addition, there was no cracking in the protective layer, that is, excellent fastness properties were exhibited, under storage conditions such that the print and the vinyl chloride sheet were put on top of each other. By contrast, for the comparative example wherein the adhesive layer does not contain any epoxy resin, dye migration took place from the dye to the vinyl chloride sheet, and, in addition, there was cracking.

Thus, according to the present invention, in a protective layer transfer sheet comprising a substrate sheet, a heat-resistant slip layer provided on one side of the substrate sheet, and a thermally transferable protective layer releasably provided on at least a part of the surface of the substrate sheet remote from the heat-resistant slip layer, the thermally transferable protective layer contains an epoxy resin and, in addition, contains at least one member selected from the group consisting of a butyral resin, an acrylic resin, and an ultraviolet absorber. By virtue of this construction, a protective layer can be strongly adhered onto an image-receiving sheet with an image formed thereon. Further, the protective layer is strong and homogeneous, and, thus, even when the print is housed in a vinyl chloride case, the print does not cause the dye to migrate to the case, that is, has excellent plasticizer resistance.

What is claimed is:

1. A protective layer transfer sheet comprising:

a substrate sheet; and a thermally transferable protective layer releasably provided on the substrate sheet, said thermally transferable protective layer comprising a combination of a main protective layer and an adhesive layer provided in that order from the substrate sheet side, said adhesive layer containing an epoxy resin and, in addition, containing at least one member selected from the group consisting of a butyral resin, an acrylic resin, an ultraviolet absorber, and a mixture thereof.

2. The protective layer transfer sheet according to claim 1, which further comprises a heat-resistant slip layer provided on the surface of the substrate sheet on its side remote from the thermally transferable protective layer.

3. The protective layer transfer sheet according to claim 1, wherein the thermally transferable protective layer is a laminate comprising a release layer, a main protective layer, and an adhesive layer provided in that order from the substrate sheet side.

4. The protective layer transfer sheet according to claim 3, wherein the release layer contains at least an acrylic resin.

5. The protective layer transfer sheet according to claim 3, wherein the release layer is non-transferable, and, upon thermal transfer, the release layer stays on the substrate sheet while the protective layer is separable from the substrate sheet.

6. The protective layer transfer sheet according to claim 1, wherein, upon thermal transfer, the thermally transferable protective layer is separable directly from the substrate sheet.

7. The protective layer transfer sheet according to claim 1, wherein the epoxy resin has a molecular weight in the range of 800 to 6000 and a glass transition temperature of 60 to 150° C.

8. The protective layer transfer sheet according to claim 1, wherein the ultraviolet absorber comprises a nonreactive ultraviolet absorber compound with a reactive group introduced thereinto.

* * * * *